US005588189A

United States Patent [19]

Gorman et al.

[11] Patent Number: 5,588,189

[45] Date of Patent: Dec. 31, 1996

[54] BUCKLE FOR VEHICLE SEAT BELT SYSTEM

[75] Inventors: Patrick J. Gorman, White Lake; Phillip D. Yee, Troy, both of Mich.; Mark F. Gray, New Market, Canada

[73] Assignee: TRW Vehicle Safety Systems Inc., Lyndhurst, Ohio

[21] Appl. No.: 518,231

[22] Filed: Aug. 23, 1995

[51] Int. Cl.[6] ..... A44B 11/00

[52] U.S. Cl. ..... 24/632; 24/635; 24/637

[58] Field of Search ..... 24/632, 633, 628, 24/637, 631, 635, 642, 656, 573.5; 297/468

[56] References Cited

U.S. PATENT DOCUMENTS

| | | | |
|---|---|---|---|
| 3,523,342 | 8/1970 | Spires . | |
| 3,605,210 | 9/1971 | Lohr . | |
| 3,649,999 | 3/1972 | Stoffel | 24/635 |
| 4,128,924 | 12/1978 | Happel et al. . | |
| 4,617,705 | 10/1986 | Anthony et al. . | |
| 4,945,615 | 8/1990 | Anthony et al. | 24/642 |
| 5,023,981 | 6/1991 | Anthony et al. . | |
| 5,038,446 | 8/1991 | Anthony et al. . | |
| 5,220,713 | 6/1993 | Lane, Jr. et al. . | |
| 5,267,377 | 12/1993 | Gillis et al. | 24/637 |
| 5,269,051 | 12/1993 | McFalls . | |
| 5,283,933 | 2/1994 | Wiseman et al. . | |

*Primary Examiner*—Victor N. Sakran

*Attorney, Agent, or Firm*—Tarolli, Sundheim, Covell, Tummino & Szabo

[57] ABSTRACT

A buckle (20) for a vehicle seat belt system (22) comprises a base (102) at least partially defining a cavity (100) for receiving first and second tongues (64, 66) of the seat belt system along respective first and second insertion paths (P1, P2). A first latch plate (106) supported by the base (102) is movable between a latched position connecting the first tongue (64) with the base when the first tongue moves a fully inserted distance into the cavity (100) and a release position in which the first tongue is disconnected from the base. A second latch plate (128) supported by the base (102) is movable between a latched position connecting the second tongue (66) with the base when the second tongue moves a fully inserted distance into the cavity (100) and a release position in which the second tongue is disconnected from the base. A first blocking member (162) has a portion (166) located in the second insertion path (P2) for blocking movement of the second tongue (66) the fully inserted distance into the cavity (100) until the first tongue (64) moves a predetermined first distance. A second blocking member (172) has a portion (176) located in the first insertion path (P1) for blocking movement of the first tongue (64) the fully inserted distance into the cavity (100) until the second tongue (66) moves a predetermined second distance.

16 Claims, 7 Drawing Sheets

BUCKLE FOR VEHICLE SEAT BELT SYSTEM

BACKGROUND OF THE INVENTION

1. Technical Field

The present invention relates to a seat belt buckle, and particularly to a seat belt buckle for a seat belt system used with a child's seat.

2. Description of the Prior Art

A seat belt restraint system for a child's seat typically includes a buckle that is attached to an end of a crotch belt. Each of two shoulder belts extends across a shoulder and a hip of a child in the seat and carries a tongue. The tongues are inserted into the buckle and latched to connect the crotch belt with the pair of shoulder belts and secure the child in the child seat.

SUMMARY OF THE INVENTION

The present invention is directed to a buckle for a seat belt system used with a vehicle seat. The buckle comprises a base at least partially defining a cavity for receiving first and second tongues of the seat belt system. The tongues are movable a fully inserted distance into the cavity along respective first and second insertion paths. A first latch plate is supported by the base and is movable between a latched position and an unlatched position. When the first latch plate is in the latched position and the first tongue is moved the fully inserted distance into the cavity, the first tongue is connected with the base and withdrawal of the first tongue from the cavity is prevented. When the first latch plate is in the unlatched position, the first tongue is disconnected from the base and withdrawal of the first tongue from the cavity is permitted.

A second latch plate is mounted on the base and is movable between a latched position and an unlatched position. When the second latch plate is in the latched position and the second tongue is moved the fully inserted distance into the cavity, the second tongue is connected with the base and withdrawal of the second tongue from the cavity is prevented. When the second latch plate is in the unlatched position, the second tongue is disconnected from the base and withdrawal of the second tongue from the cavity is permitted.

A first blocking member has a portion located in the second insertion path for blocking movement of the second tongue the fully inserted distance into the cavity until the first tongue moves a predetermined distance into the cavity along the first insertion path. A second blocking member has a portion located in the first insertion path for blocking movement of the first tongue the fully inserted distance into the cavity until the second tongue moves a predetermined distance into the cavity along the second insertion path.

The first blocking member has a first condition which blocks movement of the second tongue the fully inserted distance into the cavity. The first blocking member has a second condition which is ineffective to block movement of the second tongue the fully inserted distance into the cavity. The first blocking member moves from the first condition to the second condition upon movement of the first tongue the predetermined distance into the cavity. The second blocking member has a first condition which blocks movement of the first tongue the fully inserted distance into the cavity. The second blocking member has a second condition which is ineffective to block movement of the first tongue the fully inserted distance into the cavity. The second blocking member moves from the first condition to the second condition upon movement of the second tongue the predetermined distance into the cavity.

The first and second latch plates are pivotable relative to the base. Each of the first and second blocking members comprises a plate which is pivotable relative to the base. Each of the first and second latch plates and the first and second blocking plates includes a cam surface for engaging a portion of a tongue upon movement of the tongue the fully inserted distance into the cavity to cause pivoting of the plate. Means is provided for interconnecting the first and second tongues in a predetermined relative position prior to movement into the cavity so the first and second tongues move together into the cavity.

BRIEF DESCRIPTION OF THE DRAWINGS

Further features and advantages of the present invention will become apparent to those skilled in the art to which the present invention relates from reading the following specification with reference to the accompanying drawings, in which.

DESCRIPTION OF PREFERRED EMBODIMENT

Figure 1:
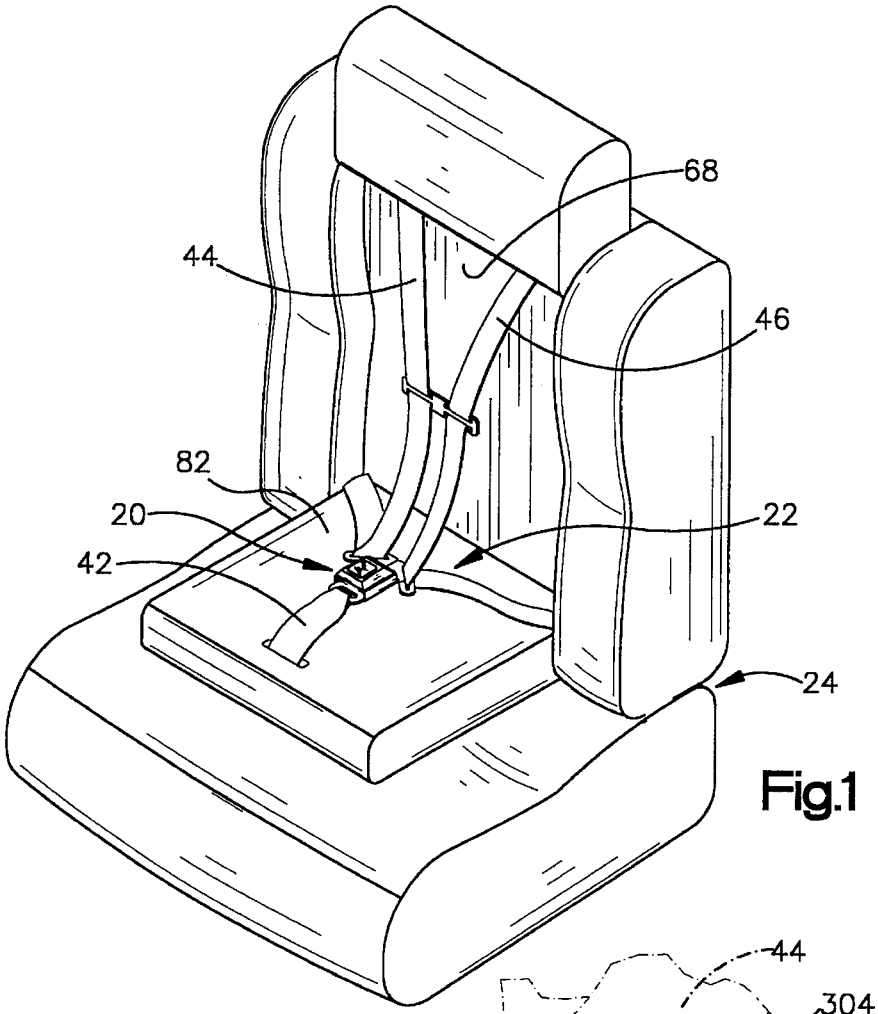
FIG. 1 is a perspective view of a vehicle child's seat having a seat belt system with a buckle embodying the present invention.
Figure 2:
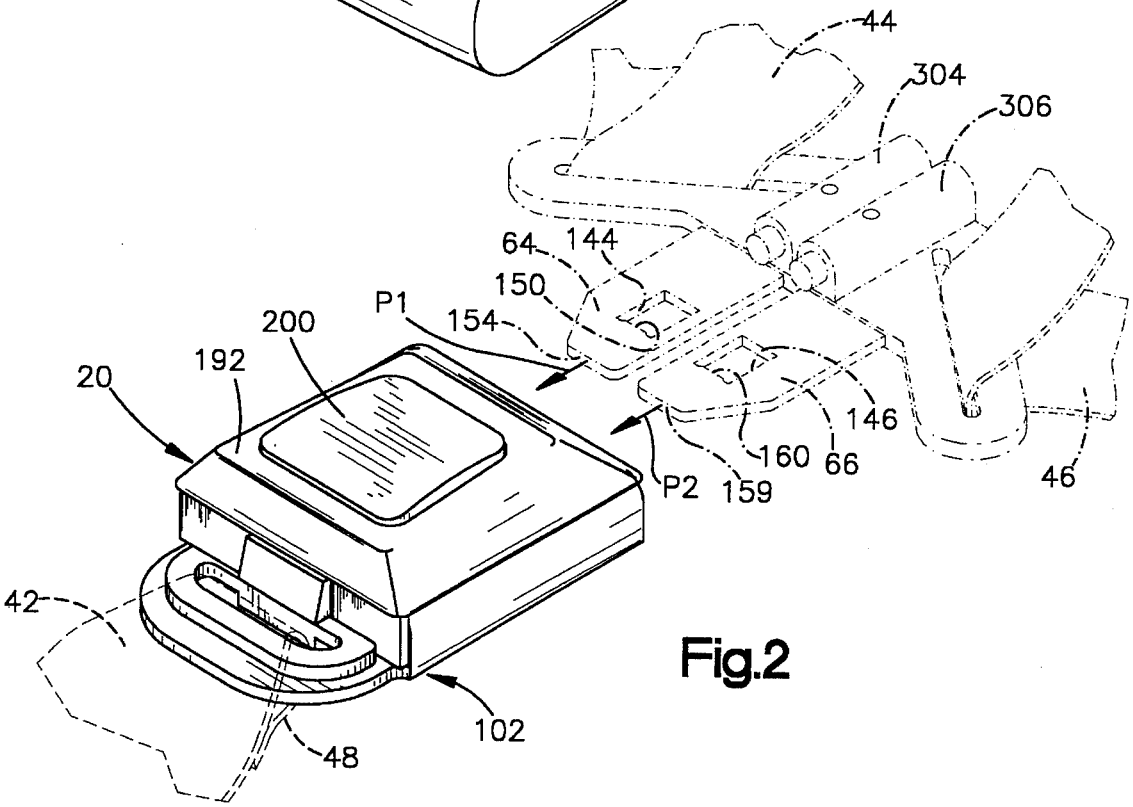
FIG. 2 is an enlarged perspective view of the buckle of the seat belt system of FIG. 1 and a pair of tongues.

A seat belt system 22 for use with a vehicle child's seat 24 is illustrated in FIGS. 1 and 2. The seat belt system 22 (FIG. 1) includes a buckle 20, a crotch belt 42 and a pair of shoulder belts 44, 46. The buckle 20 is connected to an end loop 48 (FIG. 2) of the crotch belt 42. The shoulder belt 44 extends through a slot in a first tongue 64. The shoulder belt 46 extends through a slot in a second tongue 66.

Upper ends of the shoulder belts 44, 46, as viewed in FIG. 1, are secured to a back 68 of the seat 24. Lower ends of the shoulder belts 44, 46 are secured to the seat 24 at a location where the seat back 68 joins a bottom cushion 82. The shoulder belts 44, 46 have upper portions which extend across the shoulders of an occupant of the seat 24. The shoulder belts 44, 46 also have lower portions which extend across the hips of the occupant of the seat 24. The crotch belt 42 extends upwardly from the seat bottom cushion 82 between the legs of the occupant of the seat 24. The buckle 20 receives the tongues 64, 66 to connect the crotch belt 42 with the shoulder belts 44, 46 and secure the occupant in the seat 24.

Figure 3:
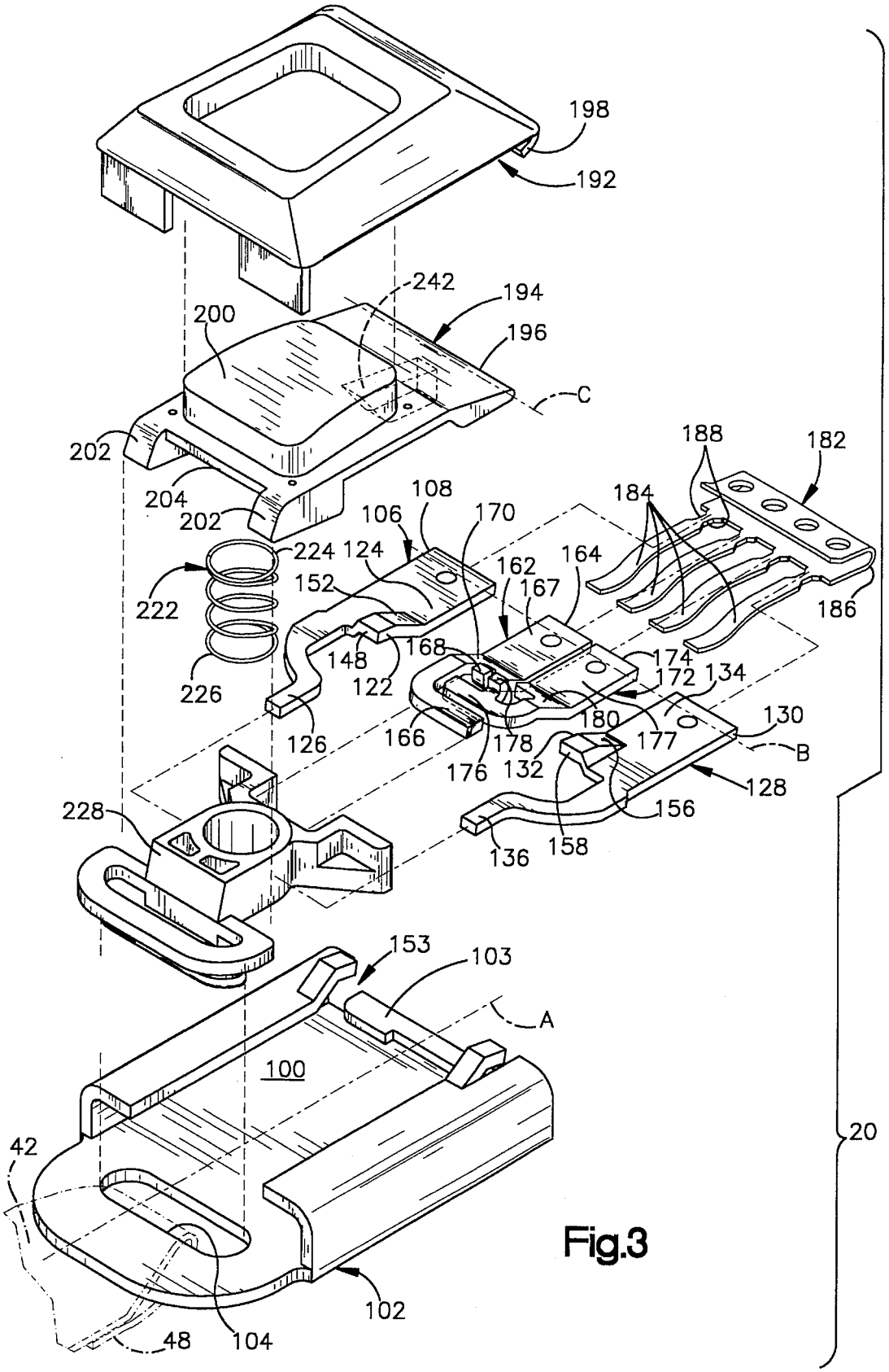
FIG. 3 is an exploded perspective of the buckle of FIG. 2.

The buckle 20 (FIGS. 2–5) includes a metal base 102 and has a longitudinal central axis A (FIG. 3). The base 102 partially defines a cavity 100 in the buckle 20 for receiving the tongues 64, 66. An upturned lip 103 is located at one axial end of a planar bottom of the base 102 and partially defines an entrance opening 153 to the cavity 100 in the buckle 20. A slot 104 (FIG. 3) is located at the other axial end of the base 102 and receives the end loop 48 of the crotch belt 42. The tongues 64, 66 are movable along respective insertion paths P1, P2 a fully inserted distance into the cavity 100 in the buckle 20. The insertion paths P1, P2 extend in a direction substantially parallel to the axis A of the base 102.

A first latch plate 106 (FIGS. 3 and 4) is supported by the base 102 in the cavity 100 to pivot about an axis B at a pivot end 108 which is located on the base adjacent the lip 103 and axially opposite the slot 104. The axis B extends perpendicular to the axis A of the base 102. The first latch plate 106 is pivotable between a latched or engaged position, and a release or disengaged position. The pivot end 108 of the first latch plate 106 is limited from moving relative to the base 102 in a direction to the right, as viewed in FIGS. 5 and 6, by the lip 103.

Figure 4:
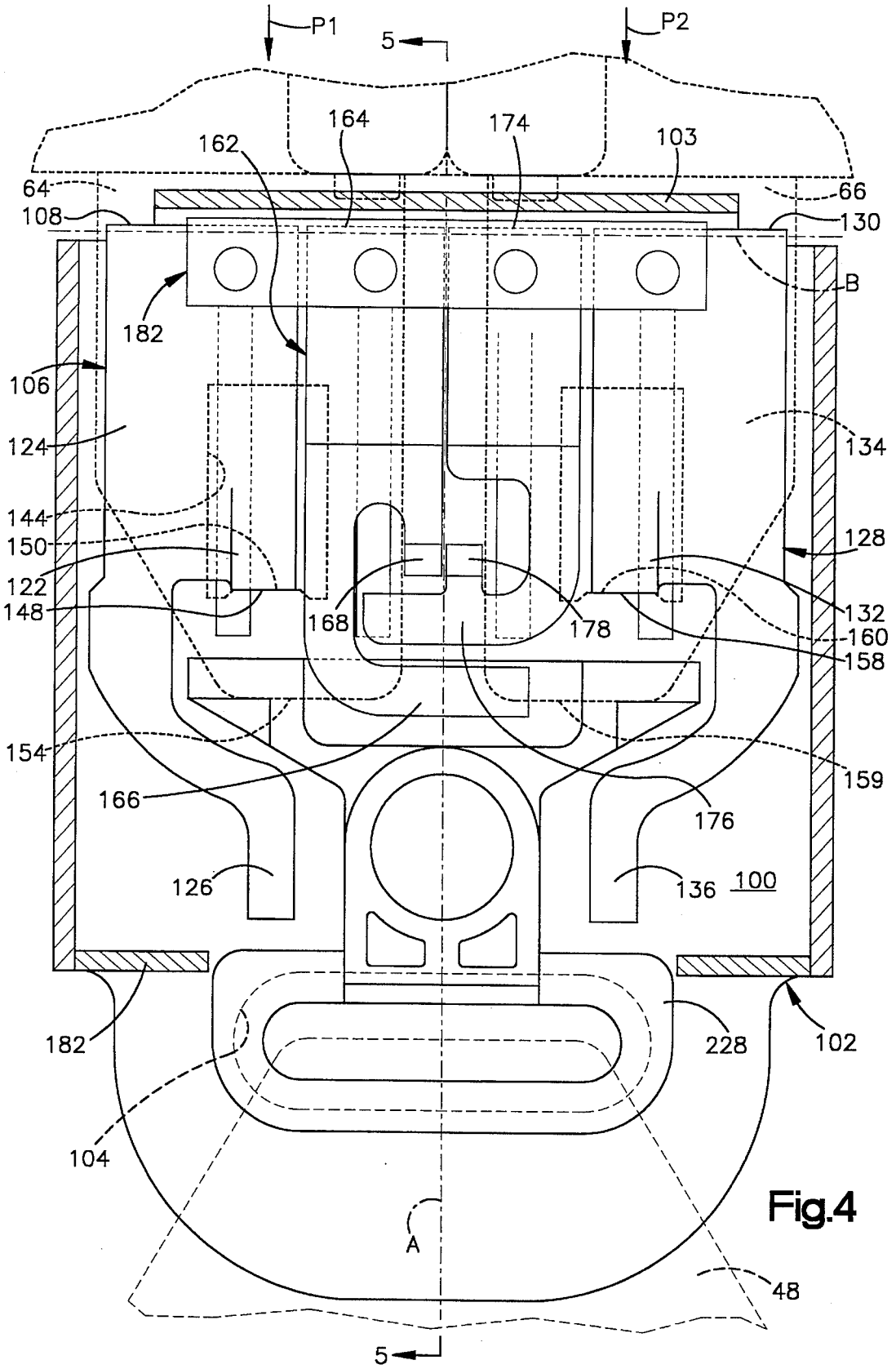
FIG. 4 is an enlarged schematic plan view of the buckle of FIG. 3 with the tongues fully inserted.
Figure 6:
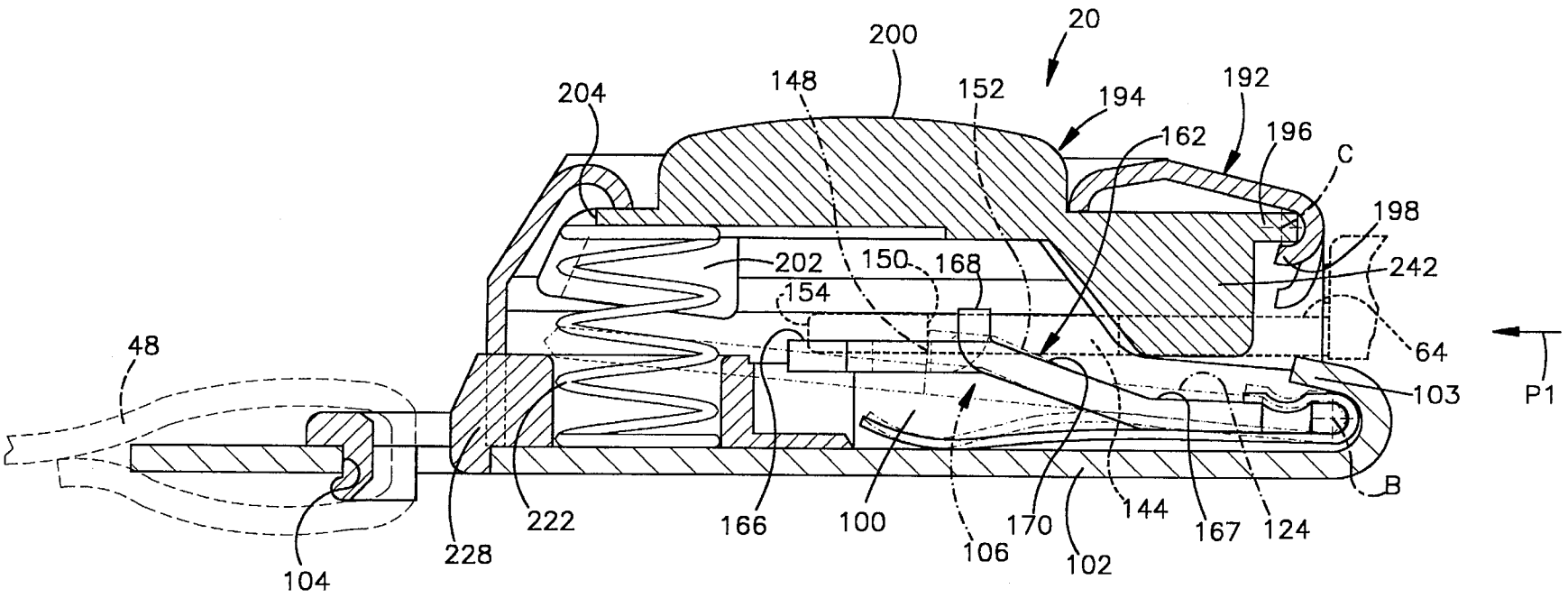
FIG. 6 is a view similar to FIG. 5 with parts in different positions.

When the first tongue 64 is moved along its insertion path P1 a fully inserted distance into the cavity 100 in the buckle 20, as illustrated in FIG. 4, and the first latch plate 106 pivots to its latched position, as illustrated in FIG. 6, the first tongue is connected to the base 102. The first tongue 64 cannot be withdrawn from the cavity 100 in the buckle 20. When the first latch plate 106 pivots to its release position, the first tongue 64 is disconnected from the base 102 and may be withdrawn from the cavity 100 in the buckle 20.

The first latch plate 106 is a generally planar metal part having a stamped latch lug 122 which extends upward, as viewed in FIG. 3, from a planar main portion 124 of the first latch plate. The first latch plate 106 also has a wing member 126 that extends away from the latch lug 122 and pivot end 108 of the latch plate in a direction parallel to the axis A and that is axially aligned with the latch lug, as viewed in FIG. 4. The wing member 126 is transversely offset from the axis A and is located in a plane which contains the planar main portion 124 of the first latch plate 106.

Figure 8:
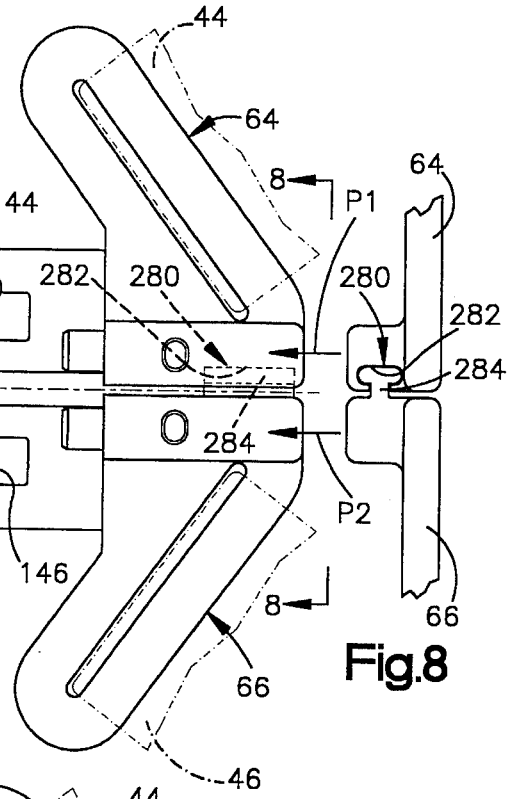
FIG. 8 is an end view of the tongues, taken approximately along the line 8—8 in FIG. 7.

The latch lug 122 of the first latch plate 106 enters a latch opening 144 (FIGS. 2, 4 and 8) in the first tongue 64 when the first tongue is moved the fully inserted distance into the cavity 100 in the buckle 20 and the first latch plate pivots to its latched position. An end surface 148 of the latch lug 122 engages an axial end surface 150 of the first tongue 64 which partially defines the latch opening 144. Engagement between the end surface 148 of the latch lug 122 and the end surface 150 that partially defines the latch opening 144 connects the first tongue 64 with the base 102. Withdrawal of the first tongue 64 from the cavity 100 in the buckle 20 in a direction to the right, as viewed in FIG. 4, is prevented by the engagement between the end surface 148 of the latch lug 122 and the end surface 150 of the first tongue 64.

The latch lug 122 of the first latch plate 106 has a cam surface 152 (FIG. 3) facing the entrance opening 153 to the cavity 100 in the buckle 20. The cam surface 152 extends upward from the planar main portion 124 of the first latch plate 106 towards the end surface 148 of the latch lug 122. The cam surface 152 is engageable with a leading end portion 154 of the first tongue 64. As the first tongue 64 is moved the fully inserted distance into the cavity 100 of the buckle 20 along the insertion path P1, the leading end portion 154 of the first tongue engages the cam surface 152 to pivot the latch plate 106. During advancement of the first tongue 64, the first latch plate 106 pivots in a counterclockwise direction about the axis B, as viewed in FIG. 5, towards the base 102 until the first tongue moves the fully inserted distance into the cavity 100. When the first tongue 64 moves the fully inserted distance, the first latch plate 106 pivots clockwise about the axis B to the latched position.

A second latch plate 128 (FIGS. 3 and 4) is supported by the base 102 in the cavity 100 to pivot at a pivot end 130 about the axis B. The second latch plate 126 is pivotable between a latched or engaged position and a release or disengaged position. When the second tongue 66 moves along its insertion path P2 a fully inserted distance into the cavity 100 in the buckle 20, as illustrated in FIG. 4, and the second latch plate 128 pivots to its latched position, the second tongue is connected with the base 102. The second tongue 66 cannot be withdrawn from the cavity 100 in the buckle 20. When the second latch plate 128 pivots to the release position, the second tongue 66 is disconnected from the base 102 and may be withdrawn from the cavity 100 in the buckle 20.

The second latch plate 128 is a generally planar metal part having a stamped latch lug 132 which extends upward, as viewed in FIG. 3, from a planar main portion 134 of the second latch plate. The second latch plate 128 has a wing member 136 that extends away from the latch lug 132 and the pivot end 130 of the latch plate in a direction parallel to the axis A and that is axially aligned with the latch lug, as viewed in FIG. 4. The wing member 132 is transversely offset from the axis A and is located in a plane which contains the planar main portion 134 of the second latch plate 128.

The latch lug 132 of the second latch plate 128 enters a latch opening 146 (FIGS. 2, 4 and 8) in the second tongue 66 when the second tongue moves the fully inserted distance into the cavity 100 in the buckle 20. An end surface 158 of the latch lug 132 engages an axial end surface 160 of the second tongue 66 which partially defines the latch opening 146. Engagement between the end surface 158 of the latch lug 132 and the end surface 160 that partially defines the latch opening 146 connects the second tongue 66 with the base 102. Withdrawal of the second tongue 66 from the cavity 100 in the buckle 20 in a direction to the right, as viewed in FIG. 4, is prevented by the engagement between the end surface 158 of the latch lug 132 and the end surface 160 of the second tongue 66.

The latch lug 132 of the second latch plate 128 has a cam surface 156 (FIG. 3) facing the entrance opening 153 of the cavity 100 in the buckle 20. The cam surface 156 extends upward from the planar main portion 134 of the second latch plate 128 toward the end surface 158 of the latch lug 132. The cam surface 156 is engageable with a leading end portion 159 of the second tongue 66. As the second tongue 66 moves the fully inserted distance into the cavity 100 in the buckle 20 along the insertion path P2, the leading end portion 159 of the second tongue 66 engages the cam surface 156 to pivot the second latch plate 128. During advancement of the second tongue 66, the second latch plate 128 pivots in a counter-clockwise direction about the axis B, as viewed in FIG. 3, in a direction towards the base 102 until the second tongue moves the fully inserted distance into the cavity 100. When the second tongue 66 moves the fully inserted distance, the second latch plate 128 pivots clockwise about the axis B to the latched position.

A first blocking plate 162 (FIGS. 3, 4 and 5) is supported by the base 102 in the cavity 100 to pivot at a pivot end 164 about the axis B. The first blocking plate 162 is located adjacent to and transversely inward of the first latch plate 106 relative to the axis A. The first blocking plate 162 has a blocking arm 166, a tab member 168 and a cam surface 170.

The blocking arm 166 is elevated from a plane containing a main planar portion 167 of the first blocking plate 162. The tab member 168 is elevated above the blocking arm 166. The cam surface 170 extends away from the pivot end 164 and upward from the main planar portion 167 of the first blocking plate 162 to the blocking arm 166. The blocking arm 166 has a portion that extends across the axis A and is located in the second insertion path P2 of the second tongue 66, as illustrated in FIG. 4. The tab member 168 partially defines the insertion path P1 of the first tongue 64.

Figure 5:
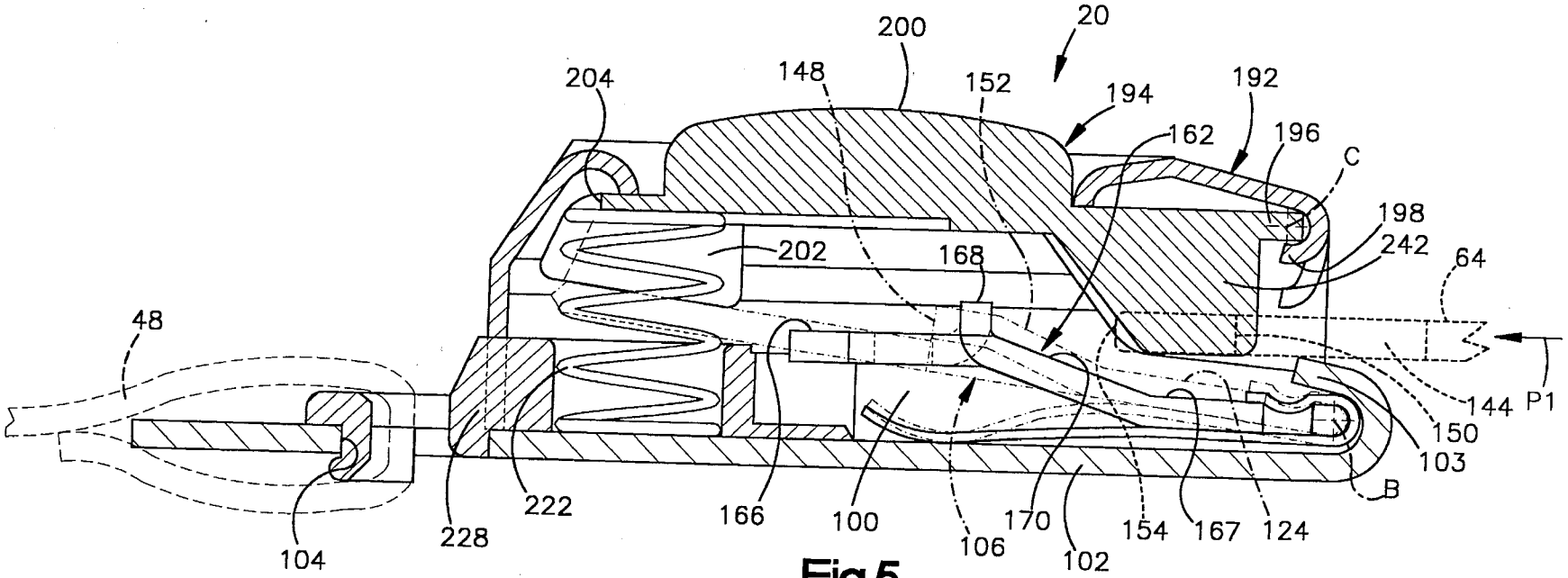
FIG. 5 is a sectional view of the buckle of FIG. 4, taken approximately along the line 5—5 in FIG. 4.

The cam surface 170 of the first blocking plate 162 has a profile similar to the cam surface 152 of the first latch plate 106. The cam surface 170 of the first blocking plate 162 and the cam surface 152 of the first latch plate 106 both engage the leading end portion 154 of the first tongue 64 during movement of the first tongue into the cavity 100 in the buckle 20. The first blocking plate 162 and the first latch plate 106 are pivoted towards the base 102 as the first tongue 64 advances in the cavity 100 in the buckle 20. The leading end portion 154 of the first tongue 64 first engages the cam surface 152 of the first latch plate 106, and the first latch plate is pivoted in a direction towards the base 102, as illustrated in FIG. 5. The leading end portion 154 of the first tongue 64 then engages the cam surface 170 of the first blocking plate 162, and the first blocking plate is pivoted in a direction towards the base 102.

The blocking arm 166 of the first blocking plate 162 prevents the second tongue 66 from moving the fully inserted distance into the cavity 100 in the buckle 20 until the first tongue 64 advances into the buckle a predetermined first distance. The predetermined first distance is less than the fully inserted distance. When the first tongue 64 is moved the predetermined first distance into the buckle 20, the first blocking plate 162 is pivoted in a direction towards the base 102. Specifically, the leading edge portion 154 of the first tongue 64 engages the cam surface 170 of the first blocking plate 162 to pivot the first blocking plate toward the base 102 and move the blocking arm 166 out of the insertion path P2 of the second tongue 66. The second tongue 66 is then permitted to move the fully inserted distance into the buckle 20 for connection with the base 102 by the second latch plate 128.

A second blocking plate 172 (FIGS. 3 and 4) is supported by the base 102 in the cavity 100 to pivot at a pivot end 174 about the axis B. The second blocking plate 172 is located adjacent to and transversely inward of the second latch plate 128 relative to the axis A. The second blocking plate 172 has a blocking arm 176, a tab member 178 and a cam surface 180.

The blocking arm 176 is elevated from a plane containing a main planar portion 177 of the second blocking plate 172. The tab member 178 is elevated above the blocking arm 176. The cam surface 180 extends away from the pivot end 174 and upward from the main planar portion 177 of the second blocking plate 172 to the blocking arm 176. The blocking arm 176 has a portion that extends across the axis A and is located in the first insertion path P1 of the first tongue 64, as illustrated in FIG. 4. The tab member 178 partially defines the second insertion path P2 of the second tongue 66.

The cam surface 180 of the second blocking plate 172 has a profile similar to the cam surface 156 of the second latch plate 128. The cam surface 180 of the second blocking plate 172 and the cam surface 156 of the second latch plate 128 engage the leading end portion 158 of the second tongue 66 during movement of the second tongue into the cavity 100 in the buckle 20. The second blocking plate 172 and the second latch plate 128 are pivoted towards the base 102 as the second tongue 66 advances in the buckle 20. The leading end portion 158 of the second tongue 66 first engages the cam surface 156 of the second latch plate 128, and the second latch plate is pivoted in a direction towards the base 102. The leading end portion 159 of the second tongue 66 then engages the cam surface 180 of the second blocking plate 172, and the second blocking plate is pivoted in a direction towards the base 102.

The blocking arm 176 of the second blocking plate 172 prevents the first tongue 64 from moving the fully inserted distance into the buckle 20 until the second tongue 66 is advanced into the buckle a predetermined second distance. The predetermined second distance is less than the fully inserted distance and is equal to the predetermined first distance. When the second tongue 66 is moved the predetermined second distance into the buckle 20, the second blocking plate 172 is pivoted in a direction towards the base 102. Specifically, the leading edge portion 159 of the second tongue 66 engages the cam surface 180 of the second blocking plate 172 to pivot the second blocking plate in a direction towards the base 102 and move the blocking arm 176 out of the insertion path P1 of the first tongue 64. The first tongue 64 is then permitted to move the fully inserted distance into the buckle 20 for connection with the base 102 by the first latch plate 106.

The latch plates 106, 128 and the blocking plates 162, 172 are all normally urged to pivot in a direction away from the base 102, as illustrated in FIGS. 5 and 6, by a spring 182 (FIGS. 3–5). The spring 182 has four individual spring fingers 184 (best seen in FIG. 3). A mounting end portion 186 of the spring 182 is hooked around the ends 108, 130, 164, 174 of each of the plates 106, 128, 162, 172 to connect the spring to the plates. Each of the spring fingers 184 is located between the base 102 and a respective plate 106, 128, 162, 172. Each spring finger 184 is associated with a respective one of the plates 106, 128, 162 or 172 to bias the plate individually to pivot in a direction away from the base 102 or in a clockwise direction about the axis B, as viewed in FIG. 5, of the respective end portion 108, 130, 164 or 174. Adjacent the mounting end portion 186, each spring finger 184 has a weakened area defined by a pair of laterally spaced notches 188 to minimize the transmission of force between the spring fingers.

A metal cover 192 is secured to the base 102. A one-piece molded plastic pushbutton 194 is pivotably supported by the cover 192. The pushbutton 194 extends substantially parallel to the base 102 and has an end portion 196 which is supported by an inturned lip 198 on the cover 192. The pushbutton 194 pivots about an axis C that extends through the end portion 196 in a direction generally parallel to the axis B of the plates 106, 128, 162, 172.

The pushbutton 194 engages and moves the latch plates 106, 128 from the latched position in a direction towards the release position. The pushbutton 194 has a manually engageable button portion 200 and two downwardly depending actuator lugs 202 (FIGS. 3 and 5) which are located on an end portion 204 of the pushbutton axially opposite the end portion 196. The actuator lugs 202 are adjacent the sides of the pushbutton 194 and are laterally offset relative to the axis A for contacting the wing members 126, 136 of the latch plates 106, 128.

The button portion 200 is manually depressed to pivot the pushbutton 194 counterclockwise, as viewed in FIG. 5, to an actuating position. The actuator lugs 202 contact the wing members 126, 136 of the latch plates 106, 128. The actuator lugs 202 transmit downward or counterclockwise pivotal movement of the pushbutton 194 to the wing members 126, 136 of the latch plates 106, 128. The wing members 126, 136 pivot the latch plates 106, 128 counterclockwise about the axis B to the release positions at which the tongues 64, 66 are disconnected from the latch plates and the base 102. The tongues 64, 66 may be withdrawn from the cavity 100 in the buckle 20. The tongues 64, 66 may be provided with spring loaded ejectors 304, 306 (FIGS. 2 and 7), as is known, to aid in moving the tongues in a direction away from the buckle 20.

A coil spring 222 urges the pushbutton 194 to pivot to a raised or unactuating position in a direction away from the base 102, as illustrated in FIG. 5, when the manual force applied to the pushbutton is released. One end 224 of the coil spring 222 engages the end portion 204 of the pushbutton 194. The other end 226 of the coil spring 222 engages a spring holder 228 which is supported by the base 102. The coil spring 222 and spring holder 228 are located centrally on the axis A and between the wing members 126, 136 of the latch plates 106, 128 and the actuator lugs 202 of the pushbutton 194. The spring holder 228 may engage an end of any of the plates 106, 128, 162, 172 to limit movement of the plate relative to the base 102 in a direction away from the lip 103.

A divider member 242 (FIGS. 3 and 5) is formed in one piece with the pushbutton 194 and extends downwardly from the end portion 196 near the entrance opening 153 of the base 102 and of the buckle 20. The divider member 242 and the tab members 168, 178 on the blocking plates 162, 172 divide the opening 153 substantially in half and define a portion of the insertion path P1 for the first tongue 64 and a portion of the insertion path P2 for the second tongue 66. The divider member 242 and the tab members 168, 178 guide the tongues 64, 66 along the insertion paths P1, P2 as the tongues are inserted into the cavity 100 in the buckle 20.

Figure 7:
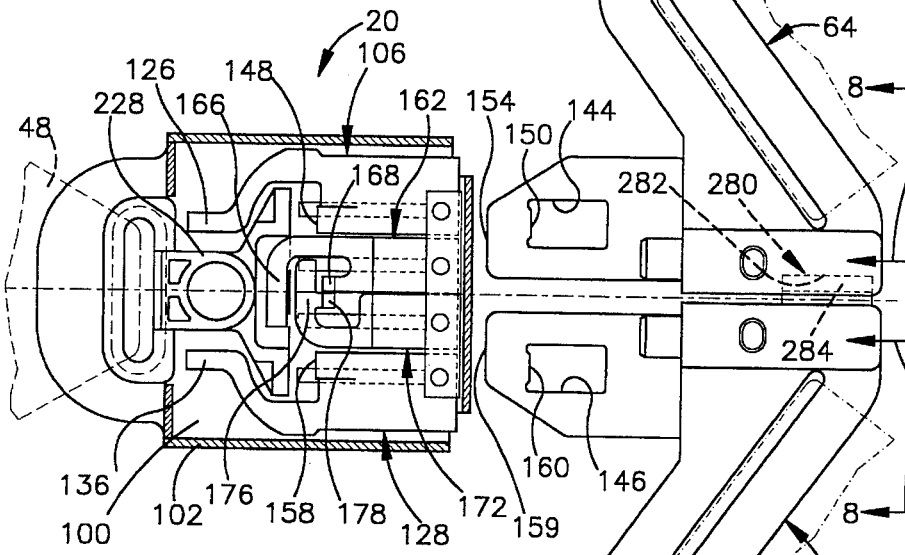
FIGS. 7, 9, 10 and 11 are schematic plan views of the buckle with the tongues in different positions.
Figure 10:
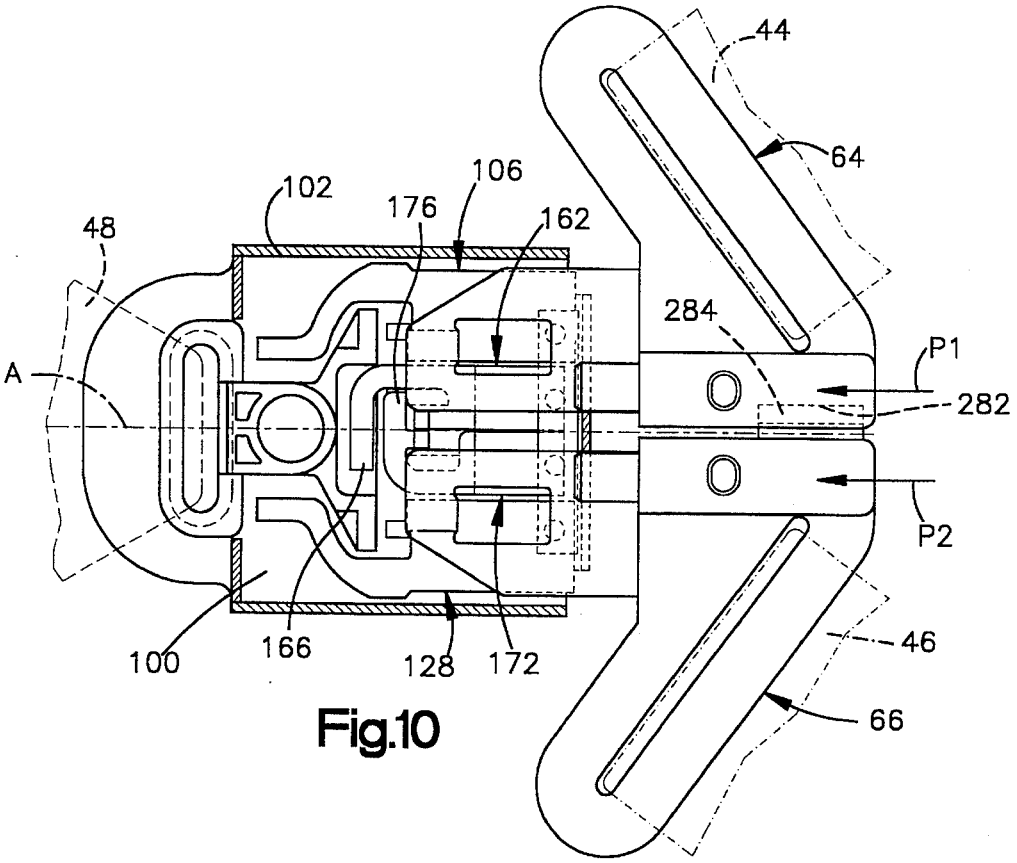
Figure 11:
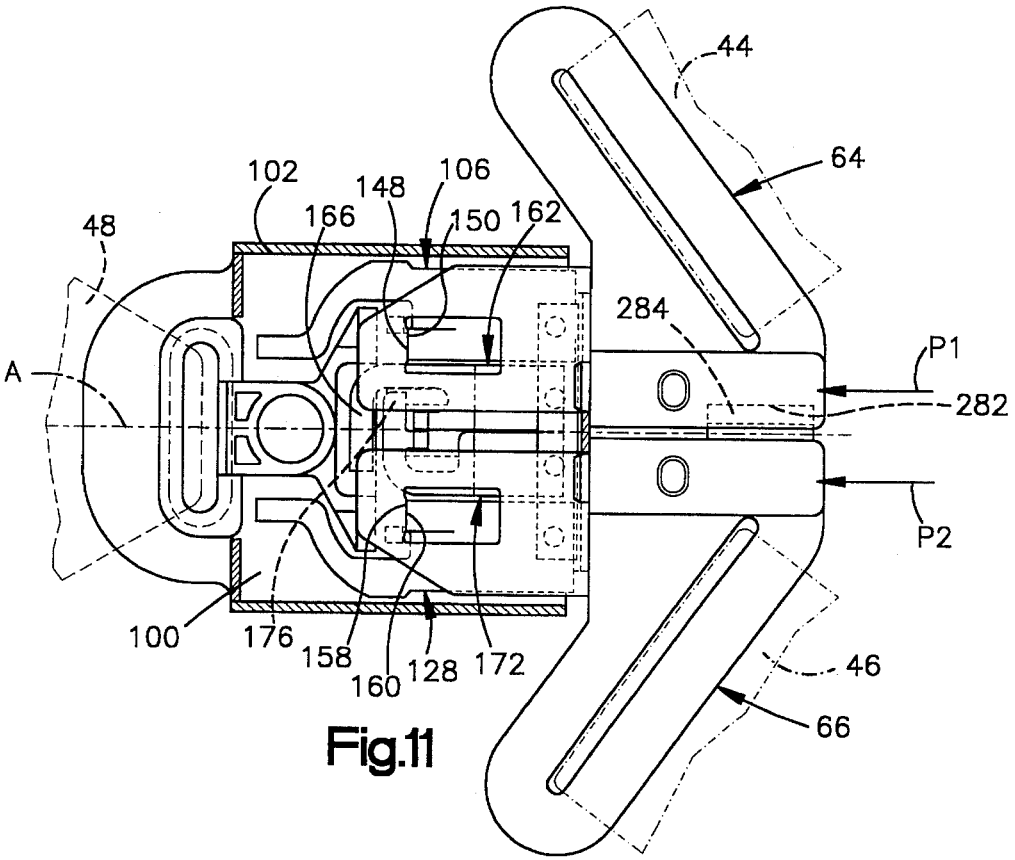

One way to assure that the tongues 64, 66 move the fully inserted distance into the buckle 20 at substantially the same time is to connect the tongues together prior to insertion into the buckle. To connect the tongues 64, 66 together, connecting structure 280, as illustrated in FIGS. 7–11, is provided. The connecting structure 280 includes a slot 282 formed in the first tongue 64. A dovetail-like projection 284 on the second tongue 66 is received in the slot 282 in the first tongue 64. The tongues 64, 66 can be connected together and advanced into the buckle 20 simultaneously as a unit, the fully inserted distance as illustrated in FIGS. 7 and 11.

Figure 9:
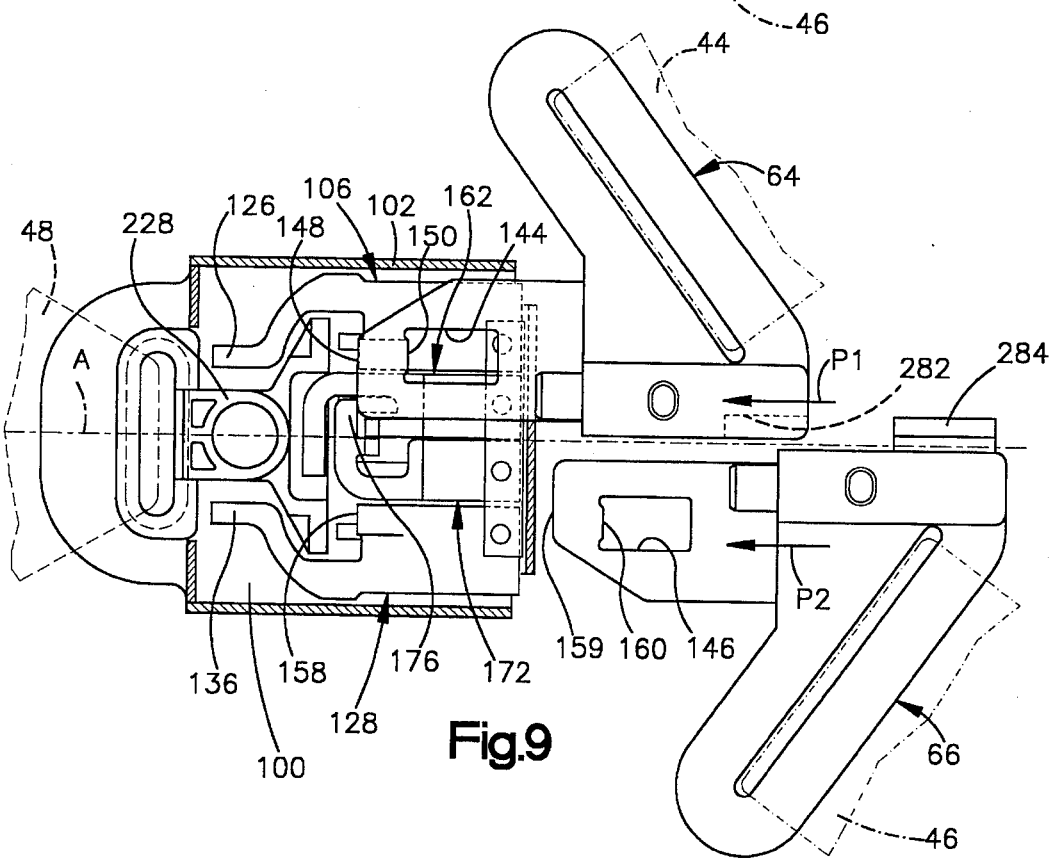

Alternatively, the first tongue 64 can be moved into the buckle 20 just short of the predetermined distance until it engages the blocking arm 176, as illustrated in FIG. 9. The second tongue 66 can then be moved into the buckle just short of the predetermined distance, as illustrated in FIG. 10, so the projection 284 enters the slot 282. Both of the tongues 64, 66 can move together the predetermined distance in the cavity 100 to pivot the blocking plates 162, 172 to the unblocking positions and then move further the fully inserted distance, as illustrated in FIG. 11.

In operation, when an occupant of the seat 24, such as a child, is to be secured in the seat belt system 22, the shoulder belts 44 and 46 are positioned around the shoulders and hips of the child. The crotch belt 42 extends upwardly between the legs of the child. The tongues 64, 66 are inserted into the buckle 20 to connect the shoulder belts 64, 66 and the crotch belt 42.

The tongues 64, 66 are moved along the insertion paths P1, P2 into the entrance opening 153 of the cavity 100 in the buckle 20. The leading end portions 154, 159 of the tongues 64, 66 engage the cam surfaces 152, 156 on the latch plates 106, 128 and the cam surfaces 170, 180 on the blocking plates 162, 172. As the tongues 64, 66 are axially moved the predetermined distance into the cavity 100 in the buckle 20 along the insertion paths P1, P2, the latch plates 106, 128 and blocking plates 162, 172 pivot in a downward or counterclockwise direction, as viewed in FIG. 4, about the axis B of the end portions 108, 130, 164, 174.

Counterclockwise pivotal movement of the latch plates 106, 128 and the blocking plates 162, 172, as viewed in FIG. 5, is resisted by the spring fingers 184. Advancing the tongues 64, 66 overcomes the biasing force of the spring fingers 184 to pivot the latch plates 106, 128 and blocking plates 162, 172 in a direction towards the base 102. As the tongues 64, 66 move further along the insertion paths P1, P2, the latch plates 106, 128 and blocking plates 162, 172 continue to pivot in the counterclockwise direction. When the tongues 64, 66 move the predetermined distances, the blocking plates 162, 172 pivot to the unblocking positions and the blocking arms 166, 176 do not prevent the tongues from advancing further.

After the tongues 64, 66 move the fully inserted distance, the latch plates 106, 128 pivot in the clockwise direction to the latched positions. The latch lugs 122 and 132 are received in the openings 144 and 146 in the tongues 64 and 66, as illustrated in FIGS. 6 and 11. The end surfaces 148, 150 of the latch lugs 122, 132 engage the end surfaces 150, 160 defining the openings 144, 146 in the tongues 64, 66 to connect the tongues to the base 102. The shoulder belts 44 and 46 are thus connected with the crotch belt 42 to secure the child in the seat 24.

To release the tongues 64, 66 from the buckle 20, the pushbutton 194 is manually depressed to pivot in a direction towards the base 102. The pushbutton 194 pivots in a downward or counterclockwise direction (as viewed in FIG. 5) about the axis C against the biasing force of the spring 222. The actuator lugs 202 (FIG. 5) on the pushbutton 194 engage the wing members 126, 136 on the latch plates 106, 128 to pivot the latch plates counterclockwise about the axis B.

The counterclockwise pivoting of the latch plates 106, 128 causes the latch plates to move to the release positions disengaged from the tongues 64, 66. The latch lugs 122, 134 are removed from the openings 144, 146 in the tongues 64, 66. The tongues 64, 66 are disconnected from the base 102 and can be removed or withdrawn from the cavity 100 in the buckle 20.

From the above description of the invention, those skilled in the art will perceive improvements, changes and modifications. Such improvements, changes and modifications within the skill of the art are intended to be covered by the appended claims.

Having described the invention, the following is claimed:

1. A buckle for use in a vehicle seat belt system, said buckle comprising:

a base at least partially defining a cavity for receiving first and second tongues of the seat belt system, each of the tongues being movable a fully inserted distance into the cavity along first and second insertion paths, respectively;

a first latch plate supported by said base and being movable between a latched position preventing withdrawal of the first tongue from the cavity and an unlatched position permitting withdrawal of the first tongue from the cavity;

a second latch plate supported by said base and being movable between a latched position preventing withdrawal of the second tongue from the cavity and an unlatched position permitting withdrawal of the second tongue from the cavity;

a first blocking member having a portion located in the second insertion path for blocking movement of the second tongue the fully inserted distance into the cavity until the first tongue moves a first predetermined distance into the cavity along the first insertion path; and a second blocking member having a portion located in the first insertion path for blocking movement of the first tongue the fully inserted distance into the cavity until the second tongue moves a second predetermined distance into the cavity along the second insertion path.

2. The buckle of claim 1 wherein said first blocking member is movable between a first condition in which said first blocking member blocks movement of the second tongue the fully inserted distance into the cavity and a second condition in which said first blocking member is ineffective to block movement of the second tongue into the cavity and further including means for moving said first blocking member from the first condition to the second condition upon movement of the first tongue the first predetermined distance into the cavity, said second blocking member being movable between a first condition in which said second blocking member blocks movement of the first tongue the fully inserted distance into the cavity and a second condition in which said second blocking member is ineffective to block movement of the first tongue into the cavity and further including means for moving said second blocking member from the first condition to the second condition upon movement of the second tongue the second predetermined distance into the cavity.

3. The buckle of claim 1 wherein said first latch plate is pivotable relative to said base and said second latch plate is pivotable relative to said base.

4. The buckle of claim 1 wherein said first blocking member comprises a plate pivotable relative to said base and said second blocking member comprises a plate pivotable relative to said base.

5. The buckle of claim 1 wherein each of said latch plates and said blocking members includes a cam surface for engagement with a tongue to cause movement of the latch plate and movement of the blocking member in response to movement of the tongue into the cavity.

6. A buckle for use in a vehicle seat belt system, said buckle comprising:

a first latch plate for engaging a first tongue of a seat belt system and preventing withdrawal of the first tongue from said buckle upon movement of the first tongue a fully inserted distance into said buckle;

a second latch plate for engaging a second tongue of the seat belt system and preventing withdrawal of the second tongue from said buckle upon movement of the second tongue a fully inserted distance into said buckle;

first blocking means for blocking movement of the second tongue the fully inserted distance into said buckle until the first tongue moves a predetermined first distance into said buckle; and second blocking means for blocking movement of the first tongue the fully inserted distance into said buckle until the second tongue moves a predetermined second distance into said buckle.

7. The buckle of claim 6 wherein said first blocking means is operable between a first condition in which said first blocking means blocks movement of the second tongue the fully inserted distance into said buckle and a second condition in which said first blocking means is ineffective to block movement of the second tongue into said buckle and further including means for operating said first blocking means from the first condition to the second condition upon movement of the first tongue the predetermined first distance into said buckle, said second blocking means being operable between a first condition in which said second blocking means blocks movement of the first tongue the fully inserted distance into said buckle and a second condition in which said second blocking means is ineffective to block movement of the first tongue into said buckle and further including means for operating said second blocking means from the first condition to the second condition upon movement of the second tongue the predetermined second distance into said buckle.

8. The buckle of claim 6 wherein the fully inserted distances that the first and second tongues move into said buckle are greater than the predetermined first distance and are greater than the predetermined second distance.

9. A buckle for use in a vehicle seat belt system, said buckle comprising:

a base at least partially defining a cavity for receiving first and second tongues of the seat belt system, the first and second tongues being movable into the cavity along first and second insertion paths, respectively;

a first latch plate pivotably supported by said base and being pivotable between a latched position connecting the first tongue with said base and an unlatched position in which the first tongue is unconnected with said base;

a second latch plate pivotably supported by said base and being pivotable between a latched position connecting the second tongue with said base and an unlatched position in which the second tongue is unconnected with said base;

a first blocking plate pivotably supported by said base and having a portion located in the second insertion path for blocking movement of the second tongue into the cavity to a connecting location at which said first latch plate can pivot to its latched position, said portion of said first blocking plate remaining in the second insertion path until the first tongue moves a predetermined first distance into the cavity; and a second blocking plate pivotably supported by said base and having a portion located in the first insertion path for blocking movement of the first tongue into the cavity to a connecting location at which said second latch plate can pivot to its latched position, said second blocking plate remaining in the first insertion path until the second tongue moves a predetermined second distance into the cavity.

10. A buckle of claim 9 wherein said first blocking plate is pivotable between a first condition in which said first blocking plate blocks movement of the second tongue into the cavity to the connecting location and a second condition in which said first blocking plate is ineffective to block movement of the second tongue into the cavity, and further including cam means on said first blocking plate engageable with said first tongue upon movement of the first tongue into the cavity the predetermined first distance for pivoting said first blocking plate from the first condition to the second condition, said second blocking plate being pivotable between a first condition in which said second blocking plate blocks movement of the first tongue into the cavity to the connecting location and a second condition in which said second blocking plate is ineffective to block movement of the first tongue into the cavity and further including cam means on said second blocking plate engageable with said second tongue upon movement of the second tongue into the cavity the predetermined second distance for pivoting said second blocking member from the first condition.

11. A buckle of a vehicle seat belt system for receiving first and second tongues, said buckle comprising:

a pivotable first blocking plate for blocking movement of the second tongue of the seat belt system a fully inserted distance into said buckle until the first tongue of the seat belt system moves into said buckle a predetermined first distance which is less than the fully inserted distance; and a pivotable second blocking plate for blocking movement of the first tongue a fully inserted distance into said buckle until the second tongue moves into said buckle a predetermined second distance which is less than the fully inserted distance.

12. The buckle of claim 11 wherein said first blocking plate is pivotable between a first position in which said first blocking plate blocks movement of the second tongue the fully inserted distance into said buckle and a second position in which said first blocking plate is ineffective to block movement of the second tongue into the buckle and further including means for pivoting said first blocking plate from the first position to the second position upon the first tongue moving the predetermined first distance into said buckle, said second blocking plate being pivotable between a first position in which said second blocking plate blocks movement of the first tongue the fully inserted distance into said buckle and a second position in which said second blocking plate is ineffective to block movement of the first tongue into said buckle and further including means for pivoting said second blocking plate from the first position to the second position upon the second tongue moving the predetermined distance into said buckle.

13. The buckle of claim 11 further including a first latch plate for connecting the first tongue with said buckle upon the first tongue moving the fully inserted distance into said buckle and a second latch plate for connecting the second tongue with said buckle upon the second tongue moving the fully inserted distance into said buckle.

14. The buckle of claim 13 further including a base at least partially defining a cavity for receiving the first and second tongues and for supporting said first and second blocking plates.

15. The buckle of claim 14 wherein said first latch plate is pivotably supported by said base and said second latch plate is pivotably supported by said base.

16. The buckle of claim 13 wherein each of said first and second latch plates and said first and second blocking plates includes a cam surface for engaging a tongue to pivot the plates upon a tongue moving into said buckle.

* * * * *